US006799691B2

(12) United States Patent
Wincent

(10) Patent No.: US 6,799,691 B2
(45) Date of Patent: Oct. 5, 2004

(54) SYSTEM FOR ASSEMBLING A BOX

(76) Inventor: Mats Wincent, Fruktvägen 61, S-155 31 Nykvarn (SE)

( * ) Notice: Subject to any disclaimer, the term of this patent is extended or adjusted under 35 U.S.C. 154(b) by 0 days.

(21) Appl. No.: 10/221,120

(22) PCT Filed: Mar. 13, 2001

(86) PCT No.: PCT/SE01/00521

§ 371 (c)(1),
(2), (4) Date: Dec. 19, 2002

(87) PCT Pub. No.: WO01/68459

PCT Pub. Date: Sep. 20, 2001

(65) Prior Publication Data

US 2003/0102310 A1 Jun. 5, 2003

(30) Foreign Application Priority Data

Mar. 14, 2000 (SE) ..... 0000836

(51) Int. Cl.[7] ..... B65D 6/16
(52) U.S. Cl. ..... 220/4.33
(58) Field of Search ..... 220/4.33, 4.16, 220/4.28

(56) References Cited

U.S. PATENT DOCUMENTS 4,083,464 A * 4/1978 Burnett ..... 217/13
5,123,541 A * 6/1992 Giannini et al. ..... 206/600
5,360,263 A 11/1994 Nakano et al. ..... 312/257.1
5,535,909 A * 7/1996 Philip ..... 220/4.33
5,558,242 A * 9/1996 Kuan ..... 220/4.31
5,566,849 A * 10/1996 Goehner ..... 220/7

FOREIGN PATENT DOCUMENTS

GB 1 446 832 A 8/1976
SE 513 684 C2 10/2000

* cited by examiner

*Primary Examiner*—Joseph Man-Fu Moy
(74) *Attorney, Agent, or Firm*—Jenkens & Gilchrist, P.C.

(57) ABSTRACT

The invention presents a system for assembling a box (1), comprising plate (3–6), each having, in the assembled condition of the box (1), an inner side and an outer side, and fittings (8, 9), each serving, in the assembled condition of the box (1), as a connection between at least two adjacent plates (3–6), and each comprising an inner fitting part (13, 13') and an outer fitting part (12, 12'), to be placed at the inner side of the plates (3–6) and the outer side of the plates (3–6) respectively. In each fitting, the inner and the outer fitting parts (13, 13', 12 12') are joined with each other by means of at least one bridge (14, 14'), the bridge (14, 14') being positioned, in the assembled condition of the box (1), between at least two of the plates (3–6), between which the fitting (8, 9) serves as a connection.

13 Claims, 6 Drawing Sheets

SYSTEM FOR ASSEMBLING A BOX

This application is a 371 of PCT/SE01/00521 filed Mar. 13, 2001.

TECHNICAL FIELD

The present invention relates to a system for assembling a box, according to the pre-characterizing clause of Patent claim 1.

PRIOR ART

With regard to assembling boxes for, for example, packing, a number of known methods exist. When, for example, heavy items are to be packed, the item, for example an engine, can be placed on a box bottom, pallet or the like, to which plates of plywood, corrugated cardboard, solid wood or the like are nailed in order to form a protective case. In this method, although it is true that the material is relatively inexpensive, the time consumption during assembly is great.

A number of systems for assembling boxes exist on the market. Examples of such systems are those marketed under various trademarks by manufacturers such as Ne-fab, Foldy Pac and Clip-lock. The disadvantage of these systems is that the component parts are relatively complex and therefore relatively expensive to manufacture. Moreover, boxes belonging to these systems are difficult to recycle because the materials, such as metal and wood, are integrated with one another and therefore difficult to separate.

GB 1 446 832 A describes a box, in which the sides are connected by strips which extend along the edges on the sides. Each strip connects two sides by virtue of longitudinal projections on the strip engaging with grooves in the sides. A disadvantage of the construction in GB 1 446 832 A is that it is difficult to fasten the lid of the box on its sides with the strips being used. It is also difficult to disassemble the box in GB 1 446 832 A without destroying component parts.

THE OBJECT OF THE INVENTION

One object of the present invention is to provide a system for assembling a box, which requires low time consumption for assembling a box and in which the component parts are simple and therefore inexpensive to manufacture. It is also an object of the present invention to provide a system for assembling a box, in which the components of the box, such as fittings, bottom, lid, sides and end walls, can be reused a number of times. A further object of the present invention is to provide a system for assembling a box, in which recycling of material included in the box and environmentally friendlier handling in the event of incineration are facilitated.

DISCLOSURE OF THE INVENTION

The object of the invention is achieved by means of a system for assembling a box having the features indicated in Patent claim 1.

By virtue of their design, it is possible to manufacture the fittings included in the system according to the invention in one piece by injection moulding, which results in low manufacturing costs. The plates included in the system are also simple from the manufacturing point of view, resulting in low manufacturing costs. The design of the system with grooved plates and securing flaps results in the work of assembling a box being very simple and brief, and also in disassembly being possible without the parts being damaged and therefore in these being reusable. The design of the system according to the invention makes material separation considerably easier, which in turn facilitates recycling and environmentally friendlier handling in the event of incineration.

DETAILED DESCRIPTION OF THE INVENTION

Figure 1:
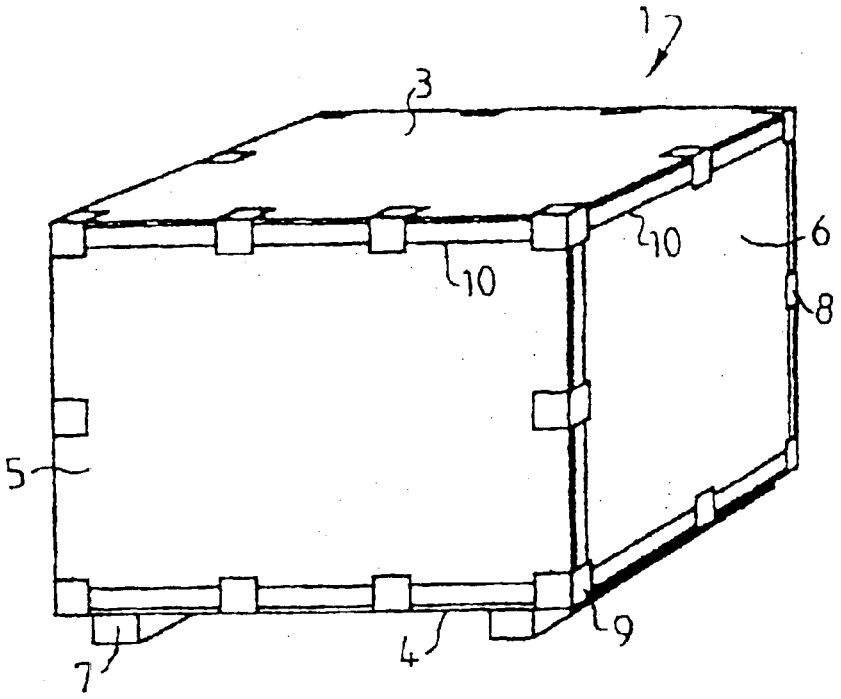
FIG. 1 shows a perspective view of a box 1 according to the invention.

FIG. 1 shows a box 1 according to the invention, comprising six plates 3–6 which constitute a lid 3, a bottom 4, two sides 5 and two end walls 6. In this embodiment, the plates 3–6 are manufactured from 9 mm, 5-ply plywood, but other thicknesses and materials can be used, such as, for example, hard and porous board, chipboard, OSB, MDF, blockboard, plastic or solid wood. The box is provided with two bottom crossbars 7. Alternatively, the bottom 4 and the bottom crossbars 7 can be replaced by a pallet. The plates 3–6 are held together by side fittings 8 and corner fittings 9.

Figure 2:
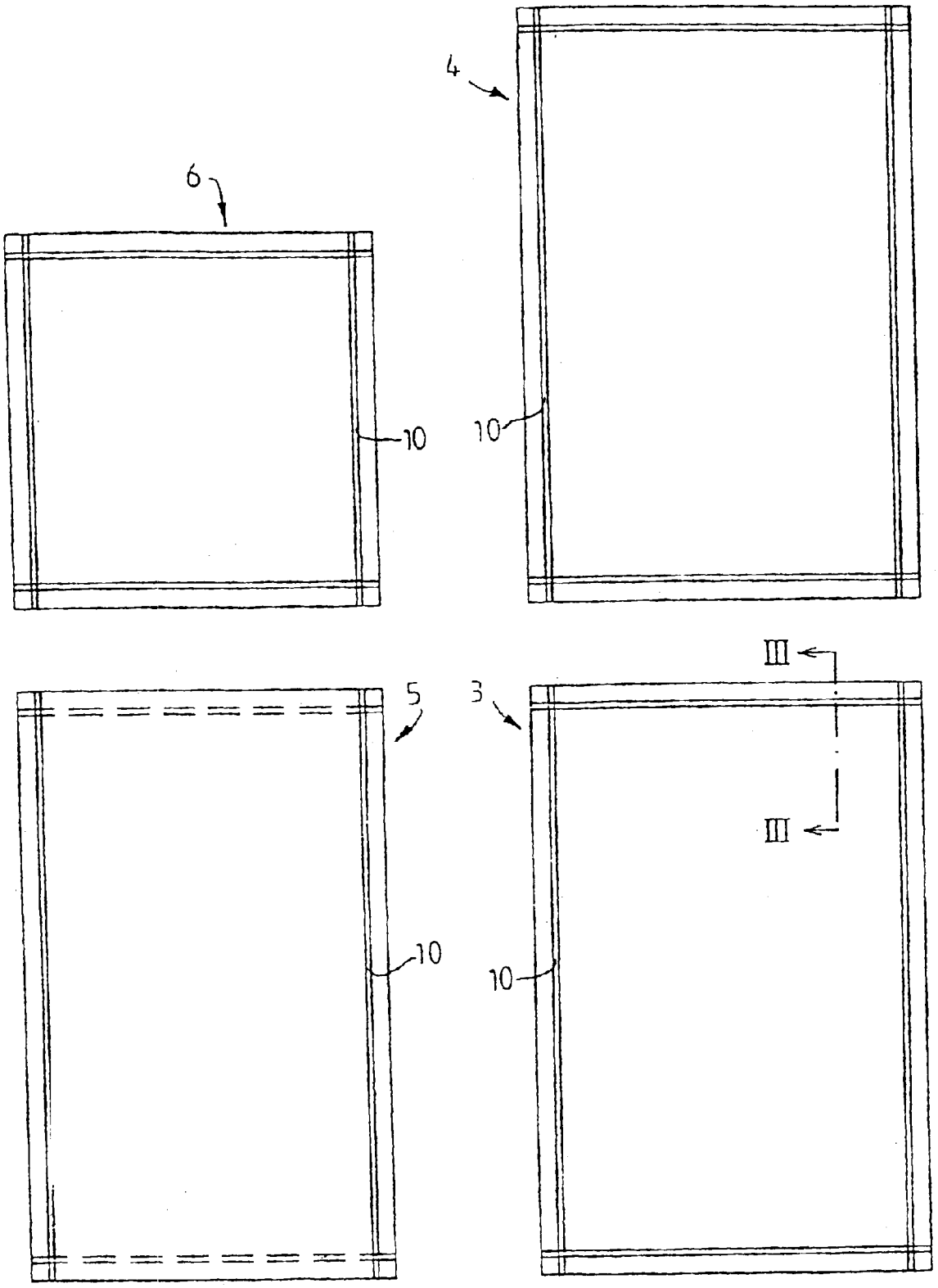
FIG. 2 shows plates for the box in FIG. 1.

FIG. 2 shows the plates 3–6 in the box 1. The lid 3, the bottom 4 and the two end walls 6 are provided, on one of their surfaces, with grooves 10. In the assembled condition of the box, the end walls 6 are turned so that the grooves 10 are located in the external surface, and the lid 3 and the bottom 4 are turned so that the grooves 10 are located in the internal surface. The grooves 10 are located close to the edges and run, on the lid 3, the bottom 4 and the two end walls 6, around the entire surface on each plate 3–6. The sides 5 have two grooves in each surface. In one surface on each side 5, the grooves 10 are located close to the edges which are intended to be joined to the lid 3 and the bottom 4. In the other surface on each side 5, the grooves 10 are located close to the edges which are intended to be joined to the end walls 6, this surface then constituting an internal surface in the assembled condition of the box 1.

Figures 3, 4:
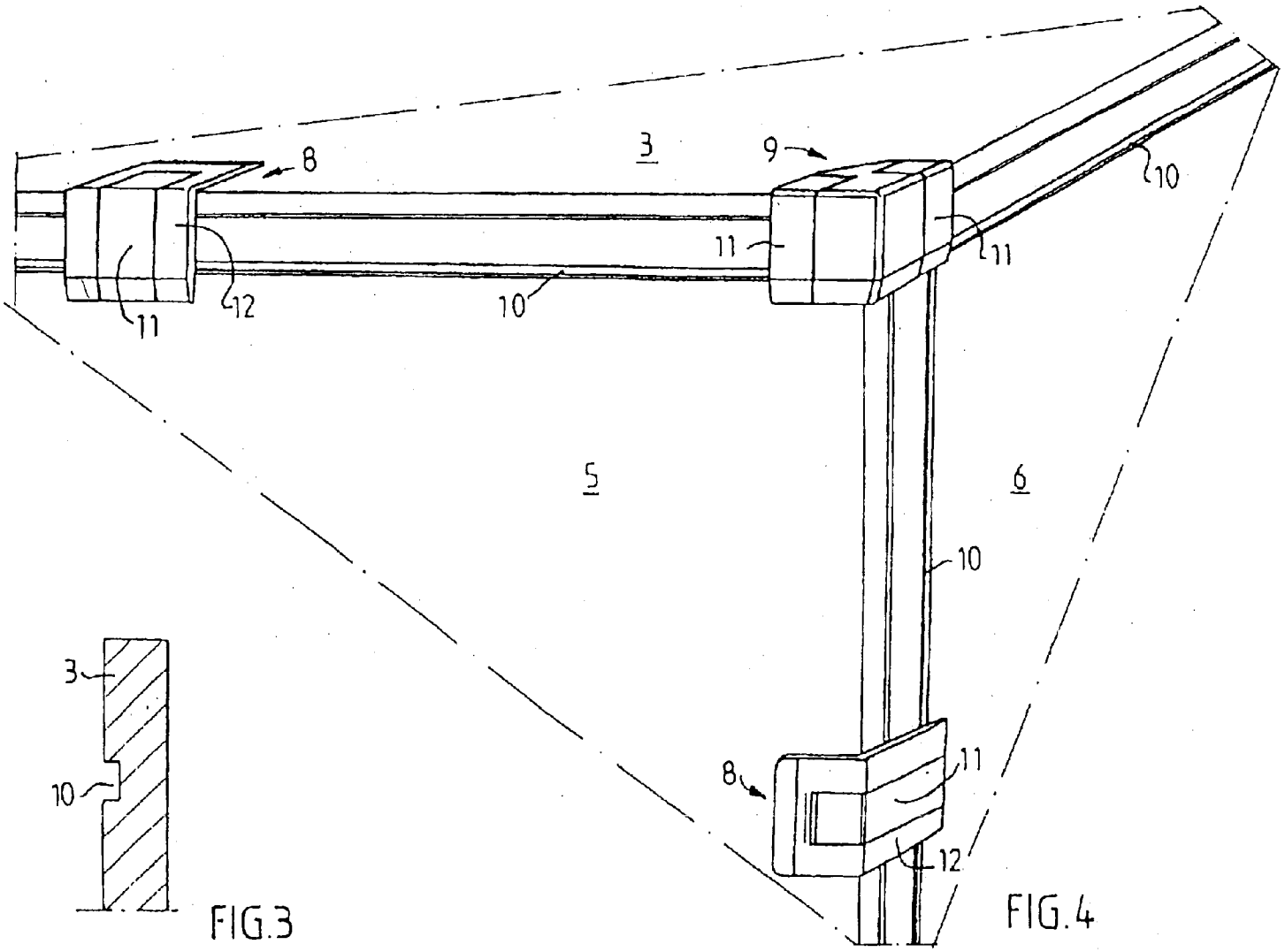
FIG. 3 shows a sectional view along the line III—III in FIG. 2.
FIG. 4 shows a perspective view of a part of the box in FIG. 1.
Figure 5:
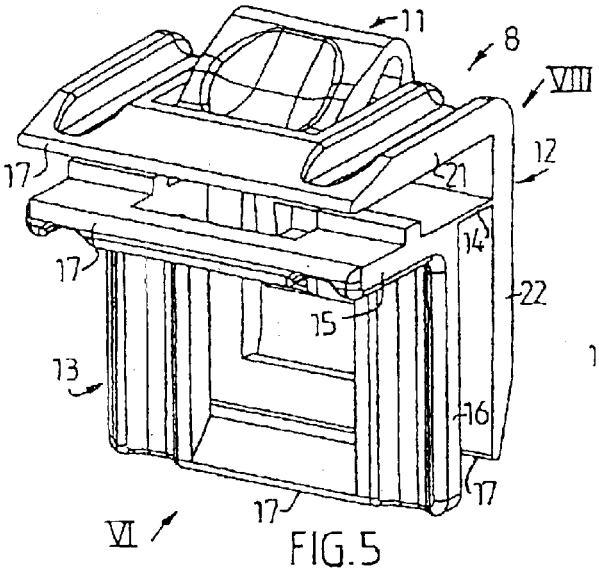
FIG. 5 shows a perspective view of a side fitting according to the invention.
Figure 6:
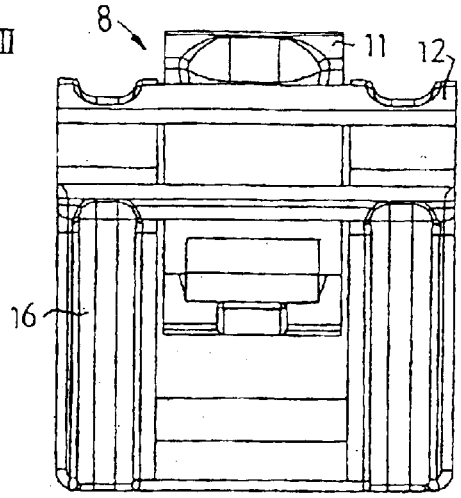
FIG. 6 shows a view of the side fitting in the direction of the arrow VI in FIG. 5.
Figure 7:
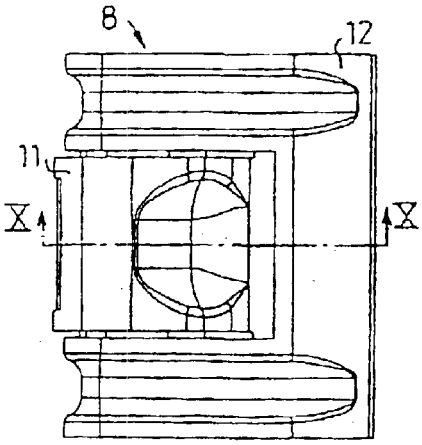
FIG. 7 shows a view from above of the side fitting in FIG. 5.
Figure 8:
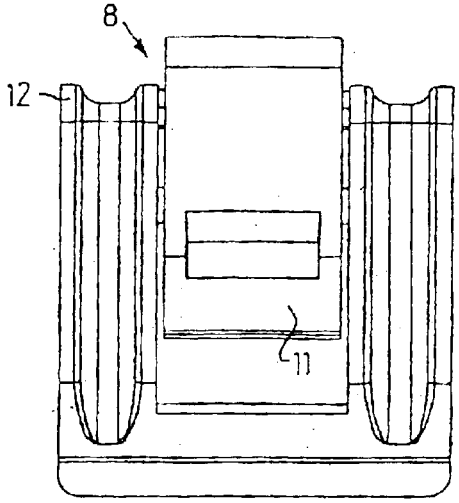
FIG. 8 shows a view of the side fitting in the direction of the arrow VIII in FIG. 5.
Figure 9:
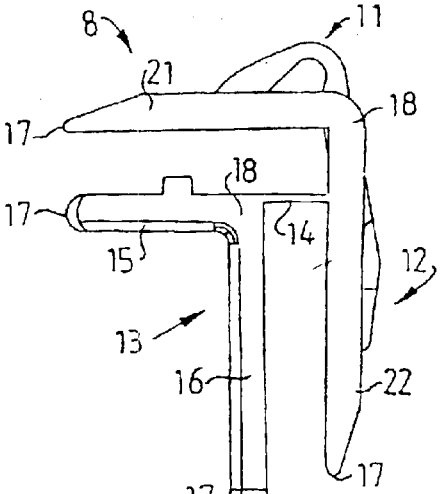
FIG. 9 shows a side view of the side fitting in FIG. 5.

FIG. 3 shows that the grooves 10 in this embodiment have a rectangular cross section. The grooves 10 are 2.5 mm deep and 6 mm wide, and are located 18 mm from the edges. Other dimensions of the grooves and their distance from the edges are of course possible. Other cross sections, for example with rounded corners, are also included within the scope of the invention.

FIG. 4 shows a corner of the box in FIG. 1 with the lid 3, one side 5 and one end wall 6, and two side fittings 8 and one corner fitting 9. These side fittings 8 and this corner fitting 9 comprise one and, respectively, two securing flaps 11 which are each in engagement with a groove 10. Each fitting 8, 9 can be manufactured, for example, as one piece of injection-moulded plastic, such as PP, PA, PE or the like. Alternatively, the fittings can be made of metal, for example steel plate, or another suitable material.

Reference is now made to FIGS. 5–10 which show various views of a side fitting 8. The side fitting 8 comprises an outer fitting part 12 which is intended to be on the outside of the box in the assembled condition of the box. An inner fitting part 13 is intended to be on the inside of the box in the assembled condition of the box. The outer fitting part 12 and the inner fitting part 13 are each essentially oriented in two planes which are at right angles to one another (see further below). The two fitting parts 12, 13 are joined by two plate-like bridges 14.

The inner fitting part 13 is an angled, frame-like component comprising a gripping part 15 and an inner support part 16 which each have a free end 17. The gripping part 15 and the inner support part 16 are oriented in planes which are essentially at right angles to one another, and they are connected to one another in two corner regions 18 (see FIG. 9). As an alternative, the inner fitting part 13 can, instead of being frame-like, be designed as an angled plate-like part. As a further alternative, the inner fitting part 13 can be designed as an angled frame which is open at one of the free ends. As yet another alternative, the inner fitting part 13 can be designed in such a manner that two or more arms replace the gripping part 15 and, respectively, the inner support part 16.

The outer fitting part 12 is, in a similar manner to the inner fitting part 13, designed as an angled frame-like component, with the difference that a securing flap 11 is arranged on the outer fitting part 12. In the event that each fitting 8, 9 is made from injection-moulded plastic, the securing flap 11 is preferably integrally connected to the other parts of the fitting. The outer fitting part 12 comprises a securing base 21 and an outer support part 22 which each have a free end 17 and meet in two corner regions 18. The outer fitting part 12 is essentially oriented in the same manner as the inner fitting part 13. In the outer fitting part 12, there is an opening for the securing flap 11. The inner fitting part 13 can also be designed as an angled frame which is open at the free end 17 of the outer support part 22.

Figure 10:
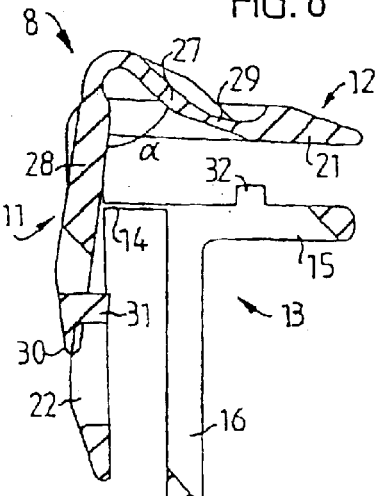
FIG. 10 shows a sectional view along the line X—X in FIG. 7.

As can be seen more clearly from FIG. 10, the securing flap 11 is attached or integrally connected to the outer fitting part 12. The securing flap comprises an inner securing part 27 and an outer securing part 28, the inner securing part 27 being located closest to the securing base 21. The two securing parts 27, 28 are essentially oriented in separate planes which form an angle $\alpha$ in relation to one another, which is roughly 75° in this embodiment. The reason for the selection of the size of this angle will emerge below.

That part of the inner securing part 27 which is located closest to the securing base 21 has a reduced thickness over the entire width of the securing flap 11 and constitutes a hinge 29 for rotation of the securing flap 11 around an axis which is parallel to an axis defined by the meeting of the planes in which the gripping part 15 and, respectively, the inner support part 16 are oriented. As the securing flap 11 is in this embodiment integrally connected to the securing base 21, the working movements in the hinge are performed by elastic bending in the material of the same. The securing flap 11 thus has a rest position in which there is no elastic bending of the hinge 29. The securing flap can be seen in its rest position in FIG. 10. Alternatively, the hinge 29 can be designed as another type of hinge or articulation.

On the inner securing part 27, on the outer side of the securing flap 11, there is suitably a recess in which a user can place a finger in order to press on the securing flap 11 during assembly of the box 1.

On the outer securing part 28, on the inner side of the securing flap 11 and close to one end 30 thereon, there is a securing shoulder 31. This securing shoulder 31 is intended to be fitted into the groove 10 in one of the plates 3–6 during assembly of the box 1, the plate being turned so that the groove is located on the outside of the box 1. The securing shoulder 31 preferably has its greatest extent in the transverse direction of the securing flap 11 and is centred in the middle thereon. In this embodiment, the securing shoulder 31 has a square cross section, in which that corner which is located furthest from the end 30 of the securing flap 11 forms a slightly acute angle. Alternatively, the cross section of the securing shoulder can be rectangular or have a different shape, for example circular. Moreover, the securing flap 11 can be provided with more than one securing shoulder 31.

In its rest position, the securing flap 11 is oriented so that the tip on the securing shoulder is situated in or slightly inside the plane defined by that side of the outer support part 22 which faces the inner fitting part 13.

The outer and inner fitting parts 12 and 13 are, as mentioned previously, joined by two bridges 14. The bridges 14, which have a relatively small thickness, extend from the corner regions 18 on the inner fitting part 13 to the outer support part 22 on the outer fitting part 12 (see FIG. 9). Each bridge 14 extends parallel to the gripping part 15, towards the outer support part 22. In this connection, that side on each bridge 14 which faces the securing base 21 on the outer fitting part 12 is oriented in the same plane as that side on the gripping part 15 on the inner fitting part 13 which also faces the securing base 21 on the outer fitting part 12.

In an alternative embodiment, the outer and inner fitting parts 12 and 13 can be joined by only one bridge 14.

The inner fitting part 13 is provided with two fixed shoulders 32 which are each located on that side of the gripping part 15 which faces towards the securing base 21 on the outer fitting part 12. These fixed shoulders 32 are arranged so as, in the assembled condition of the box, to fit into the groove 10 on a plate 3–6 which is turned with the grooved surface towards the inside of the box 1. The fixed shoulders 32 have their greatest extent in the transverse direction of the gripping part 15 and have a rectangular cross section. Alternatively, the inner fitting part can be provided with only one fixed shoulder.

Figure 11:
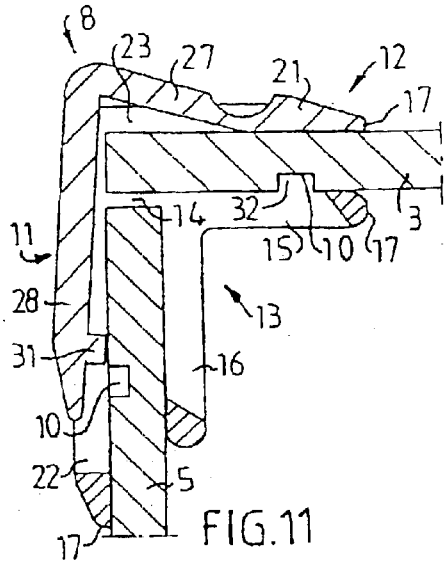
FIG. 11 shows a sectional view of a fitting according to the invention, in the assembled, unsecured state.
Figure 12:
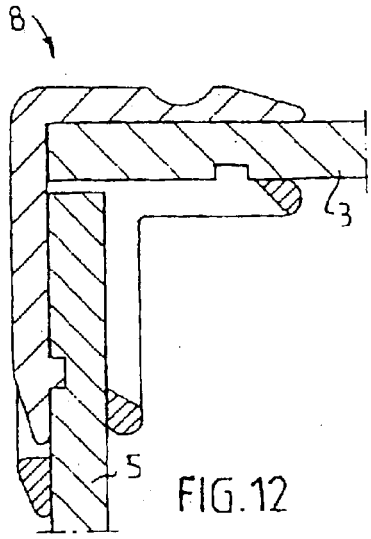
FIG. 12 shows a sectional view corresponding to FIG. 11 with the fitting in the assembled, secured state.
Figure 13:
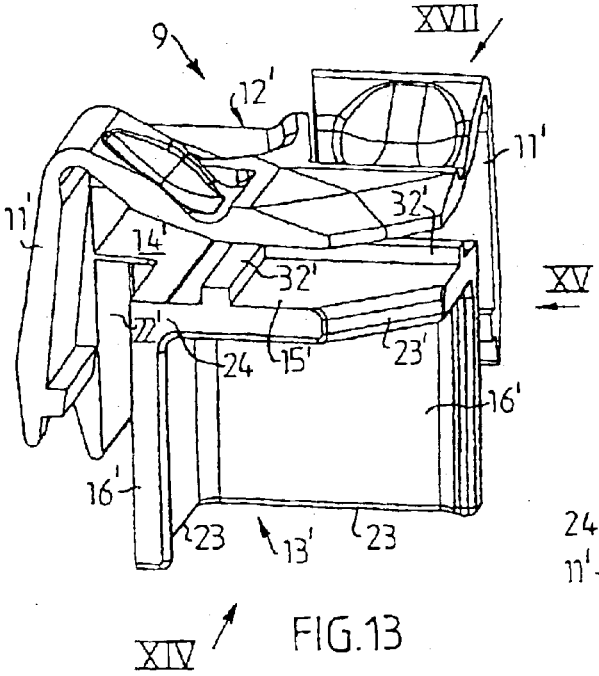
FIG. 13 shows a perspective view of a corner fitting according to the invention.
Figure 14:
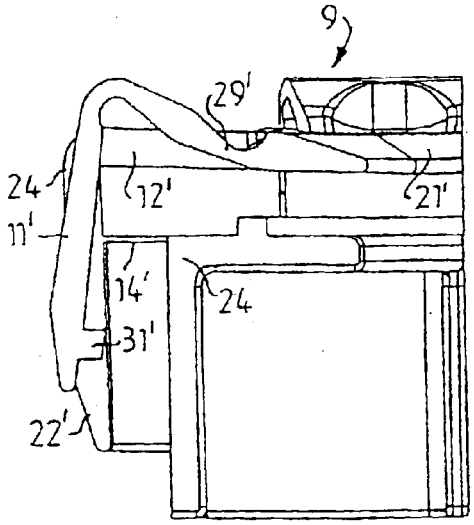
FIG. 14 shows a view of the corner fitting in the direction of the arrow XIV in FIG. 13.
Figure 15:
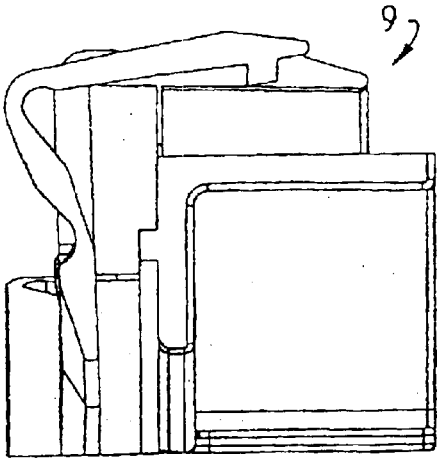
FIG. 15 shows a view of the corner fitting in the direction of the arrow XV in FIG. 13.
Figure 16:
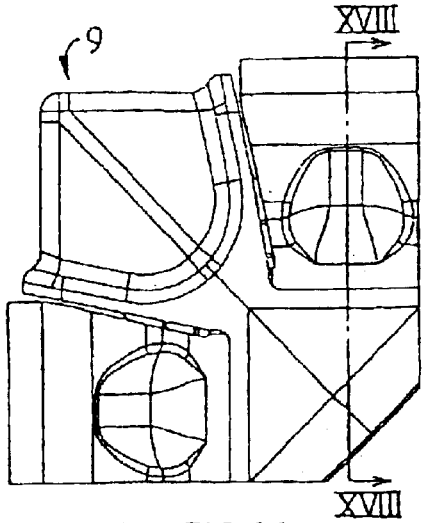
FIG. 16 shows a view from above of the corner fitting in FIG. 13.
Figure 17:
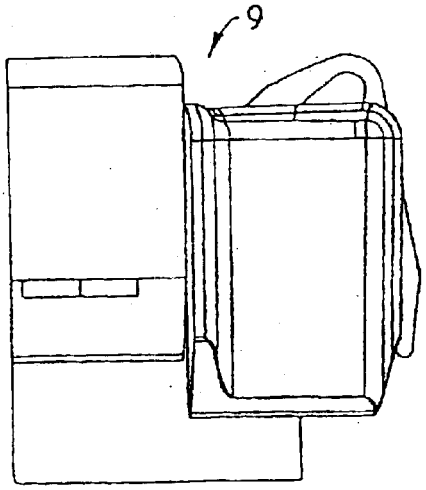
FIG. 17 shows a view of the corner fitting in the direction of the arrow XVII in FIG. 13.
Figure 18:
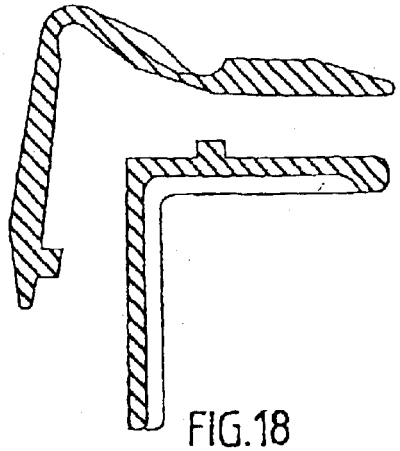
FIG. 18 shows a sectional view along the line XVIII—XVIII in FIG. 16.

FIGS. 11 and 12 show an example of the functioning of one of the side fittings 8 The corner fittings 9 function in a similar way (see further below). In this example, the side fitting 8 serves as a connection between the lid 3 and one of the sides 5 of the box 1. During assembly, the lid 3 is inserted into a space between the outer fitting part 12 and the inner fitting part 13, that is to say between the gripping part 15 and the securing base 21. In this connection, the fixed shoulders 32 are fitted into the groove 10 in the lid 3. When the lid 3 is inserted into the side fitting 8, a certain elastic deformation of the side fitting 8 takes place, the distance between the free ends 17 on the gripping part 15 and the securing base 21 increasing until the fixed shoulders 32 have been fitted into the groove 10.

The side 5 is inserted into the space between the inner support part 16 and the outer support part 22, that surface on the side 5 which has grooves 10 located at the edges to be connected to the lid 3 and, respectively, the bottom 4 being turned outwards (cf. above with reference to FIG. 2). The distance between the inner support part 16 and the outer support part 22 at the free end 17 of the outer support part 22 is slightly smaller than the distance between the two fitting parts 12, 13 at the bridges 14. This means that, during assembly of the box, when the side fitting 8 has been placed on the plates 3, 5 but before it has been secured by the securing flap 11, it is prevented from moving freely along the edges on the plates because the inner support part 16 and the outer support part 22 "pinch" the side 5 in.

Finally, the user presses the inner securing part 27 of the securing flap 11 towards the outer surface of the lid 3, the securing shoulder 31 moving, or snapping, into the groove 10 on the side 5.

On the securing flap 11, the two securing parts 27, 28 preferably form an angle a which is smaller than 90°. This results in the securing flap 11, in its secured position, in which it encloses one of the edges of the box 1, is subjected to elastic deformation, the angle a between the two securing parts 27, 28 in the secured position of the securing flap 11 being greater than the angle between the two securing parts 27, 28 in the unsecured position of the securing flap 11. The deformation of the securing flap results in the securing shoulder 31 bearing under pressure against one side in the groove 10. This counteracts the securing shoulder 31 moving out of the groove 10, and thus the securing flap 11 moving out of its secured position.

Reference is now made to FIGS. 13–18 which show various views of a corner fitting 9. The corner fitting 9 comprises an outer fitting part 12' which is intended to be on the outside of the box in the assembled condition of the box. An inner fitting part 13' is intended to be on the inside of the box in the assembled condition of the box. The outer fitting part 12' and the inner fitting part 13' are each essentially oriented in three planes which are angled at 90° in relation to one another, with minor deviations (see further below). The two fitting parts 12', 13' are joined by a plate-like bridge 14'.

The inner fitting part 13' comprises a gripping part 15' and two inner support parts 16' which each have a free edge 23. The two inner support parts 16' are at right angles to one another, being joked together at one of their edges. The gripping part 15' is in turn oriented at right angles to the two inner support parts 16' and is connected to these in two edge regions 24. As an alternative, the inner fitting part 13' can be designed in such a manner that three or more arms replace the inner support parts 16'.

The outer fitting part 12' is designed in a similar manner to the inner fitting part 13', with the difference that two securing flaps 11' are joined to the outer fitting part 12'. The outer fitting part 12' comprises a securing base 21' and two outer support parts 22' which each have free edges 23. The two outer support parts 22' are essentially at right angles to one another, being joined together at one of their edges. The securing base 21' is in turn oriented essentially at right angles to the two outer support parts 22' and is connected to these in two edge regions 24. The outer fitting part 12' is essentially oriented in the same manner as the inner fitting part 13'. The two securing flaps 11' are each located on their own side of the outer support parts 22' and are moreover rotated by 90° relative to one another in relation to an axis which is at right angles to the securing base 21'.

The securing flaps 11' are attached or integrally connected to the securing base 21' on the outer fitting part 12'. The securing flaps 11' are designed in the same manner as in the case of the side fitting 8 described above. Therefore, they each have their own hinge 29'. The working movements in the hinges take place by elastic bending in the material of the same. On the securing flaps 11', there are securing shoulders 31' which are intended to be fitted into grooves 10 in two of the plates 3–6 during assembly of the box 1, the plates being turned so that the grooves are located on the outside of the box 1.

The outer and inner fitting parts 12' and 13' are, as mentioned previously, joined by a bridge 14'. This bridge 14' extends, in the edge regions 24 of the inner fitting part 13', around the corner which is formed by the two inner support parts 16'. The bridge 14', which has a relatively small thickness, extends from the edge regions 24 on the inner fitting part 13' to the outer support parts 22' on the outer fitting part 12'. Each bridge 14' extends parallel to the gripping part 15', towards the outer support parts 22'. In this connection, that side on each bridge 14' which faces the securing base 21' on the outer fitting part 12' is oriented in the same plane as that side on the gripping part 15' on the inner fitting part 13' which also faces the securing base 21' on the outer fitting part 12'.

In alternative embodiments, the outer and inner fitting parts 12' and 13' can be joined by two or more bridges 14'.

The inner fitting part 13' is provided with two fixed shoulders 32' which are angled at 90° in relation to one another. These shoulders 32' are located on that side of the gripping part 15' which faces the securing base 21' on the outer fitting part 12'. The shoulders 32' are arranged so as, in the assembled condition of the box, to fit into grooves 10 on a plate 3–6 which is turned with the grooved surface towards the inside of the box 1. In this embodiment, the shoulders 32' meet and form a corner. Alternatively, they can be separated.

The functioning of the corner fittings 9 is essentially the same as the functioning of the side fittings 8 (compare above with reference to FIGS. 11 and 12). Each corner fitting 9 serves as a connection between the lid 3 or the bottom 4 and one of the sides 5 and one of the end walls 6 of the box 1. During assembly, the lid 3 is inserted into a space between the outer fitting part 12' and the inner fitting part 13', that is to say between the gripping part 15' and the securing base 21'. In this connection, the fixed shoulders 32' are fitted into the grooves 10 in the lid 3.

A side 5 and an end wall 6 are inserted into the space between the inner support parts 16' and the outer support parts 22', the grooves 10 of the end wall 6 being turned outwards. In a similar manner to in the case of the side fittings 8, the distance between the inner support parts 16' and the outer support parts 22' at the free edges 23 of the outer support parts 22' is slightly smaller than the distance between the two fitting parts 12', 13' at the bridge 14'. This means that, during assembly of the box, the corner fitting 9 obtains a provisional grip on the side 5 and, respectively, the end wall 6 before the securing flaps 11' are snapped firmly into place.

Finally, the user presses on the securing flaps 11' so that securing shoulders 31' move into the grooves 10 on the side 5 and, respectively, the end wall 6.

In this context, the term box means a container, case or enclosure which may be open or closed and which may have small or large dimensions and can be movable or stationary.

In this context, the term groove means cutouts which may be extended, designed as indications or the like with limited extent, or through-openings or holes in the plates 3–6.

Figure 19:
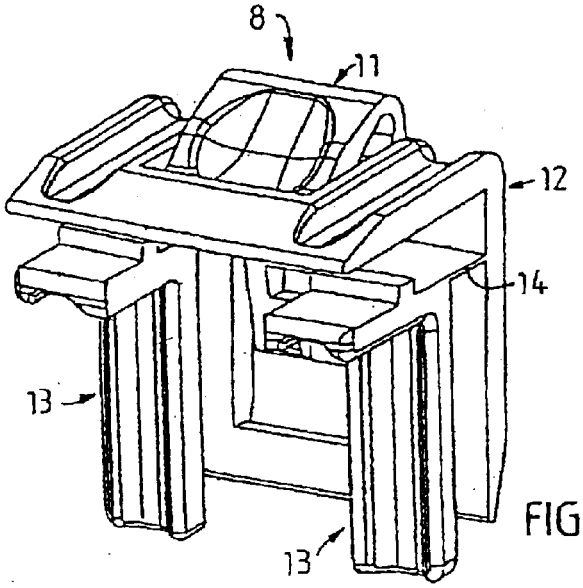
FIG. 19 shows a perspective view of a side fitting according to an alternative embodiment of the invention.

FIG. 19, shows a side fitting 8, according to an alternative embodiment of the invention. It corresponds to the side fitting as described above, except for the feature that it comprises two inner fitting parts 13.

Further alternatives are possible, including the fitting 8, 9 comprising more than two fixed shoulders, The side fitting 8 comprising more than one securing flap 11. Also, more than one securing shoulder 31, 31' can be located on each securing flap 11, 11'.

What is claimed is:

1. A system for assembling a box, the system comprising:

a plurality of plates, each of the plurality of plates having, in an assembled condition of the box, an inner side and an outer side;

a plurality of fittings, each of the plurality of fittings serving, in the assembled condition of the box, as a connection between at least two adjacent plates of the plurality of plates;

wherein each of the plurality of fittings comprises at least one inner fitting part and at least one outer fitting part;

wherein the at least one inner fitting part is adapted to be placed at the inner side of the plurality of plates;

wherein the at least one outer fitting part is adapted to be placed at the outer side of the plurality of plates;

wherein an inner fitting part and an outer fitting part of each fitting of the plurality of fittings are joined with each other by means of at least one bridge;

wherein the at least one bridge is, in the assembled condition of the box, positioned between at least two of the plurality of plates;

wherein each of the plurality of fittings serves as a connection between at least two of the plurality of plates;

wherein at least one of the plurality of fittings is provided with at least two shoulders;

wherein at least two of the plurality of plates are provided with at least one groove;

wherein, in the assembled condition of the box, at least one of the at least two shoulders is engaged with at least one groove of a first plate of the plurality of plates;

wherein at least one of the plurality of fittings is provided with at least one securing flap;

wherein at least one of the at least two shoulders constitutes a securing shoulder and is located on the at least one securing flap;

wherein the at least one securing flap is movable between an un-secured and a secured position; and wherein the securing shoulder, at the secured position of the at least one securing flap, is engaged with at least one groove of a second plate of the plurality of plates.

2. The system for assembling a box according to claim 1, wherein:

the at least one securing flap is, at one end, connected to the at least one outer fitting part via a hinge; and the at least one securing flap, by means of the hinge, can rotate around an axis parallel to two of the plurality of plates, between which the at least one fitting serves as a connection.

3. The system for assembling a box according to claim 2, wherein:

the at least one securing flap comprises an inner securing part, located closest to the hinge, and an outer securing part, connected to the inner securing part and on which the securing shoulder is located;

at the secured position of the at least one securing flap, the inner securing part extends along the outer side of one of the plurality of plates, and the outer securing part extends along the outer side of an adjacent plate of the plurality of plates;

the securing flap, in its secured position, is subjected to an elastic deformation, so that an angle (a) between the inner and outer securing parts is larger in the secured position of the at least one securing flap than in the un-secured position of the at least one securing flap.

4. The system for assembling a box according to claim 1, wherein the plurality of fittings comprise side fittings, each side fitting serving, in the assembled condition of the box, as a connection between two adjacent plates of the plurality of plates.

5. The system for assembling a box according to claim 4, wherein the inner fitting part of each side fitting is provided with at least one fixed shoulder, engaging, in the assembled condition of the box, a groove on the inner side of one of the plurality of plates.

6. The system for assembling a box according to claim 1, wherein the fittings comprise corner fittings, each serving, in the assembled condition of the box, as a connection between three adjacent plates.

7. The system for assembling a box according to claim 6, wherein the inner fitting part of each corner fitting is provided with at least one fixed shoulder, engaging, in the assembled condition of the box, at least one groove on the inner side of one of the plurality of plates.

8. The system for assembling a box according to claim 6 or 7, wherein:

the outer fitting part of each corner fitting is provided with two securing flaps; and the securing shoulders are engaged, at the secured position of the securing flaps, with grooves on the outer sides of two adjacent plates.

9. A fitting adapted for a system according to claim 1, the fitting comprising:

at least one inner fitting part at least one outer fitting part;

wherein the inner fitting part and the outer fitting part are joined with each other by means of at least one bridge;

at least two shoulders;

at least one securing flap;

wherein at least one of the at least two shoulders is located on the at least one securing flap; and wherein the securing flap is movable.

10. The fitting according to claim 9, wherein the securing flap is, at one end, connected to the outer fitting part via a hinge.

11. The fitting according to claim 9, wherein the fitting constitutes a corner fitting adapted to serve as a connection between three adjacent plates of a box.

12. The fitting according to claim 11, wherein the outer fitting part thereof is provided with two securing flaps.

13. A plate adapted for a system according to claim 1.

* * * * *

UNITED STATES PATENT AND TRADEMARK OFFICE

CERTIFICATE OF CORRECTION

PATENT NO. : 6,799,691 B2
APPLICATION NO. : 10/221120
DATED : October 5, 2004
INVENTOR(S) : Mats Wincent It is certified that error appears in the above-identified patent and that said Letters Patent is hereby corrected as shown below:

| | |
|---|---|
| Face of Patent;<br>Abstract Section, line 2 | Replace “plate”<br>With --plates-- |
| Face of Patent;<br>Abstract Section, line 10 | Replace “13, 13’, 12 12”’<br>With --13, 13’, 12, 12’-- |
| Column 5, line 38 | Replace “a”<br>With --α-- |
| Column 5, line 60 | Replace “joked”<br>With --joined-- |

Signed and Sealed this

Eighth Day of August, 2006

JON W. DUDAS
*Director of the United States Patent and Trademark Office*